US011326782B2

(12) United States Patent
Thomas

(10) Patent No.: US 11,326,782 B2
(45) Date of Patent: May 10, 2022

(54) HEATING APPLIANCE

(71) Applicant: HESTIA CONCEPTS LTD, Canterbury (GB)

(72) Inventor: Samuel Haydn Andrew Thomas, Canterbury (GB)

(73) Assignee: HESTIA CONCEPTS LTD, Kent (GB)

( * ) Notice: Subject to any disclaimer, the term of this patent is extended or adjusted under 35 U.S.C. 154(b) by 36 days.

(21) Appl. No.: 16/335,542

(22) PCT Filed: Aug. 25, 2017

(86) PCT No.: PCT/GB2017/052498
§ 371 (c)(1),
(2) Date: Mar. 21, 2019

(87) PCT Pub. No.: WO2018/055327
PCT Pub. Date: Mar. 29, 2018

(65) Prior Publication Data

US 2019/0346144 A1 Nov. 14, 2019

(30) Foreign Application Priority Data

Sep. 22, 2016 (GB) ..... 1616149

(51) Int. Cl.
*F24B 1/26* (2006.01)
*F24B 5/02* (2006.01)
*F24B 13/00* (2006.01)

(52) U.S. Cl.
CPC ..... *F24B 1/26* (2013.01); *F24B 5/02* (2013.01); *F24B 13/00* (2013.01)

(58) Field of Classification Search
CPC ..... F24B 1/26; F24B 5/028; F24B 13/004; F24B 13/04; F24B 1/187; F24B 1/1895;
(Continued)

(56) References Cited

U.S. PATENT DOCUMENTS 3,993,040 A * 11/1976 Antone ..... F24B 1/02 126/60
4,583,452 A 4/1986 Grosse
(Continued)

FOREIGN PATENT DOCUMENTS

CA 2 252 213 A1 4/2000
CN 202173287 U 3/2012
(Continued)

OTHER PUBLICATIONS

PCT/GB2017/052498 International Search Report & Written Opinion, dated Mar. 12, 2018.
(Continued)

*Primary Examiner* — Jason Lau
(74) *Attorney, Agent, or Firm* — Fay Sharpe LLP

(57) ABSTRACT

A heating appliance (1) comprises a main body (2) having a fire-box (9) with an opening (10) for placing combustible fuel (11) therein with which the heating appliance (1) is used. The heating appliance (1) has a fire door (3) for closing the opening (10), and a movable baffle (4). The baffle (4) is placable in a first position in which it is disposed in a front part of the fire-box (9), it is behind the fire door (3), and it forms a shield for the combustible fuel (11).

12 Claims, 9 Drawing Sheets

(58) Field of Classification Search

CPC ..... A47J 37/0704; A47J 37/0763; A47J 37/0786; A47J 37/07; A47J 43/28; A47J 2037/0777; A47J 36/06; A47J 36/12; A47J 36/36; A47J 37/041; A47J 37/079; A47J 37/1271; A47J 2037/0795; A47J 27/002; A47J 27/004; A47J 27/14; A47J 33/00; A47J 37/0676; A47J 37/0713; A47J 37/0864; A47J 37/1295; A47J 43/283; F24C 15/2035; F24C 15/2028; F24C 15/2042; F24C 15/20; F24C 15/2007; F24C 15/2021; F24C 7/08; F24C 3/14; F24C 7/085; F24C 15/02; F24C 15/12; F24C 15/162; F24C 15/2092; F24C 15/32; F24C 15/325; F24C 1/16; F24C 3/085; F24C 7/087

See application file for complete search history.

(56) References Cited

U.S. PATENT DOCUMENTS

| | | | | |
|---|---|---|---|---|
| 4,825,845 | A * | 5/1989 | Olivotti | A47J 37/06 126/12 |
| 5,148,737 | A * | 9/1992 | Poulson | A47J 37/041 99/327 |
| 5,588,420 | A | 12/1996 | Dickson | |
| 5,598,834 | A | 2/1997 | Grady | |
| 5,931,148 | A | 8/1999 | Freeman | |
| D460,893 | S | 7/2002 | Rowe | |
| 6,546,926 | B1 * | 4/2003 | Perrault | F24B 5/025 126/77 |
| 6,748,939 | B1 | 6/2004 | Gober | |
| 7,841,270 | B2 * | 11/2010 | Holbrook | A47J 37/0786 99/395 |
| 2002/0017289 | A1 | 2/2002 | Carr et al. | |
| 2004/0031478 | A1 | 2/2004 | Gifford | |
| 2005/0126556 | A1 | 6/2005 | Bossler | |
| 2006/0137543 | A1 | 6/2006 | McLemore et al. | |
| 2007/0047166 | A1 * | 3/2007 | Creel | F24B 1/192 361/118 |
| 2008/0149618 | A1 * | 6/2008 | Chung-Ting | A47J 37/0864 219/393 |
| 2011/0168153 | A1 | 7/2011 | Purinton et al. | |
| 2012/0318255 | A1 | 12/2012 | Brown | |
| 2014/0336836 | A1 | 12/2014 | Coffman | |
| 2016/0363324 | A1 * | 12/2016 | Barry | F24B 5/025 |

FOREIGN PATENT DOCUMENTS

| | | | |
|---|---|---|---|
| DE | 32 18 944 | A1 | 11/1983 |
| FR | 2 755 503 | A1 | 5/1988 |
| GB | 778084 | | 7/1957 |
| GB | 2 313 294 | A | 11/1997 |
| GB | 2 377 162 | A | 1/2003 |
| GB | 2 417 672 | A | 10/2006 |
| JP | 3 195822 | A | 8/1991 |
| KR | 10 1617585 | B1 | 5/2016 |
| WO | WO 2007/019589 | A1 | 2/2007 |

OTHER PUBLICATIONS

GB 1616149.9 Search Report under Section 17 dated Feb. 8, 2017.

GB 1616149.9 Further Search Report under Section 17 dated Sep. 28, 2017.

http://www.williams-sonoma.com/products/landmann-napa-charcoal-grill/#, Jul. 24, 2016 (Image retrieved by Wayback Machine on Mar. 20, 2019).

http://shop.biggreenegg.co.uk, Aug. 13, 2016 (Image retrieved by Wayback Machine on Mar. 20, 2019).

www.ozpig.co.uk,, Oct. 18, 2016 (Image retrieved by Wayback Machine on Mar. 20, 2019).

* cited by examiner

HEATING APPLIANCE

The present invention relates to a heating appliance, and, more particularly, to a heating appliance that can act as an outdoor heater or as an outdoor cooker. The heating appliance may thus be a cooking appliance.

An outdoor heating appliance has a fire-box with a fire door wherein the fire door is opened to place combustible fuel in the fire-box. The outdoor heating appliance also has a sealable top lid wherein the lid is opened and food placed on a grill above the fire-box is cooked directly by heat radiating from the fuel when it is combusting. When a person is using the heating appliance to cook food the heat radiating from the heating appliance may make it uncomfortable for the person to stand close to the grill.

It is an object of the present invention to provide a heating appliance to alleviate the above-mentioned problem.

According to one aspect of the present invention there is provided a heating appliance comprising a main body having a fire-box with an opening for placing combustible fuel therein with which said heating appliance is used, a fire door for closing said opening, and a movable baffle, in which said baffle is placable in a first position in which it is disposed in a front part of said fire-box, it is behind said fire door, and it forms a shield for said combustible fuel. The heating appliance may include a food holding part above the fire-box, in which heat generated by the combustible fuel in use cooks food which is placed in or on the food holding part. Thus, a person cooking food in or on the food holding part is protected from heat from the fuel combusting by the baffle in the first position. The fire door may have a window. The window may comprise a pane. The window may be translucent or transparent. The window may comprise glass. The baffle in the first position protects the window from fat/grease residue spitting from food cooking in or on the food holding part above.

The heating appliance may include a flue exhaust. The flue exhaust may be located above the fire-box. The flue exhaust may be above the food holding part.

The baffle may be movable between the first position and a second position. The baffle in the second position may be disposed in an upper or top part of the fire-box. The baffle may form a shield for combustible fuel beneath. The baffle may also be below the food holding part. When the baffle is in the second position at least some of the heat generated by the fuel combusting may be directed by the baffle through the window. A substantial amount of heat may be directed by the baffle through the window. The heat projected through the window by the baffle thus provides more heat in front of the heating appliance so that it can act as an outdoor or patio heater as well as an outdoor cooker. When the baffle is in the second position it blocks or contains fire from the combusting fuel creating a hotter fire when further fuel is added. The flue exhaust may be located substantially above the baffle when the baffle is in the second position. The baffle in the second position prevents flames from going directly up the flue exhaust. The baffle provides a tortuous route for products of combustion to travel as they have to pass in front of, and to each side of, the baffle before they exhaust through the flue exhaust. This enables the exhaust gases to dissipate much more of their heat before being vented through the flue exhaust, allowing for lower exhaust temperatures and providing greater efficiency. When the baffle is in the second position, the window may allow an attractive view of flames from combusting fuel to be seen.

The heating appliance may include at least one air inlet for supplying air to the inside of the fire-box for combusting the combustible fuel. The at least one air inlet may be located above the window. Air in the at least one air inlet may be heated by combusting fuel. The at least one air inlet may be located above the fire door or may be located in a top portion of the fire door. Thus, a flow of air past the window may be provided preventing the accumulation of soot and smoke stains on the window. When the baffle is in the second position it may deflect flames towards the front of the fire-box to engage and mix with air from the air inlet(s) which is drawn to the flames igniting volatiles and unburnt carbons or smoke emitting from the combusting fuel thus providing cleaner combustion and less impact on the environment. The heating appliance may include a control device for controlling supply of air through the at least one air inlet.

The heating appliance may include a lid to form a seal with the main body. The lid may be configured to cover the food holding part. The lid may include a thermometer. The thermometer enables the temperature inside the lid or in a top or upper part of the fire-box to be monitored to provide for optimum cooking performance when the lid is closed over the food holding part. The control device for controlling supply of air into the at least one air inlet can then be adjusted to control the cooking. The seal prevents ingress of air so that cooking temperature can be finitely controlled by the control device when the heating appliance is being used as a cooker. The seal preventing ingress of air also means that heat output can be finitely controlled when the heating appliance is being used as an outdoor heater.

The fire-box may be insulated. The insulation of the fire-box may comprise panels on the inside of the fire-box. The lid may be insulated.

The food holding part may comprise a food receiving member. The food holding part may be rotatably connected to the main body and be rotatable between first and second food holding part positions, wherein when the food holding part is in the first food holding part position the food receiving member is higher above or higher in relation to the fire-box than when the food holding part is in the second food holding part position. This enables different sizes of cooking products to be accommodated. When the food receiving member is in the first food holding part position, this allows easy access to and the cooking of small portions of food such as skewered kebabs, sausages and chicken breasts. If a large portion of food needs to be cooked such as a joint of meat or a whole chicken or, say, a loaf of bread needs to be cooked then the food receiving member is rotated to the second food holding part position to provide a greater depth for receiving the large portion of food. This also helps protect the inside of the lid from touching the food. When the food holding part is in the first food holding part position the food receiving member may be substantially at the top of the main body. The food receiving member may comprise a grill. The grill may comprise a searing plate such as a cast iron searing plate for cooking steaks. The combusting fuel beneath the grill can smoke the food thereon. A pizza stone may be supported by the food receiving member when the food holding part is in its second position so allowing the easy baking of pizza.

The baffle may be removable from the heating appliance.

The main body may be substantially cylindrical in shape and have a substantially vertical longitudinal axis.

When the baffle is in the second position, the baffle may be disposed at least partially to one side of the opening. The baffle may be rotatable substantially about the longitudinal axis between the first position and the second position.

According to another aspect of the present invention there is provided a heating appliance comprising a main body having a fire-box with an opening for placing combustible fuel therein with which said heating appliance is used, and a food holding part rotatably connected to said main body above said fire-box, in which heat generated by said combustible fuel in use cooks food with which said heating appliance is used which is placed in or on said food holding part, said food holding part being rotatable between first and second positions, wherein when said food holding part is in said first position said food receiving member is higher above said fire-box than when said food holding part is in said second position.

Embodiments of the present invention will now be described, by way of example, with reference to the accompanying schematic drawings, in which.

Figure 1:
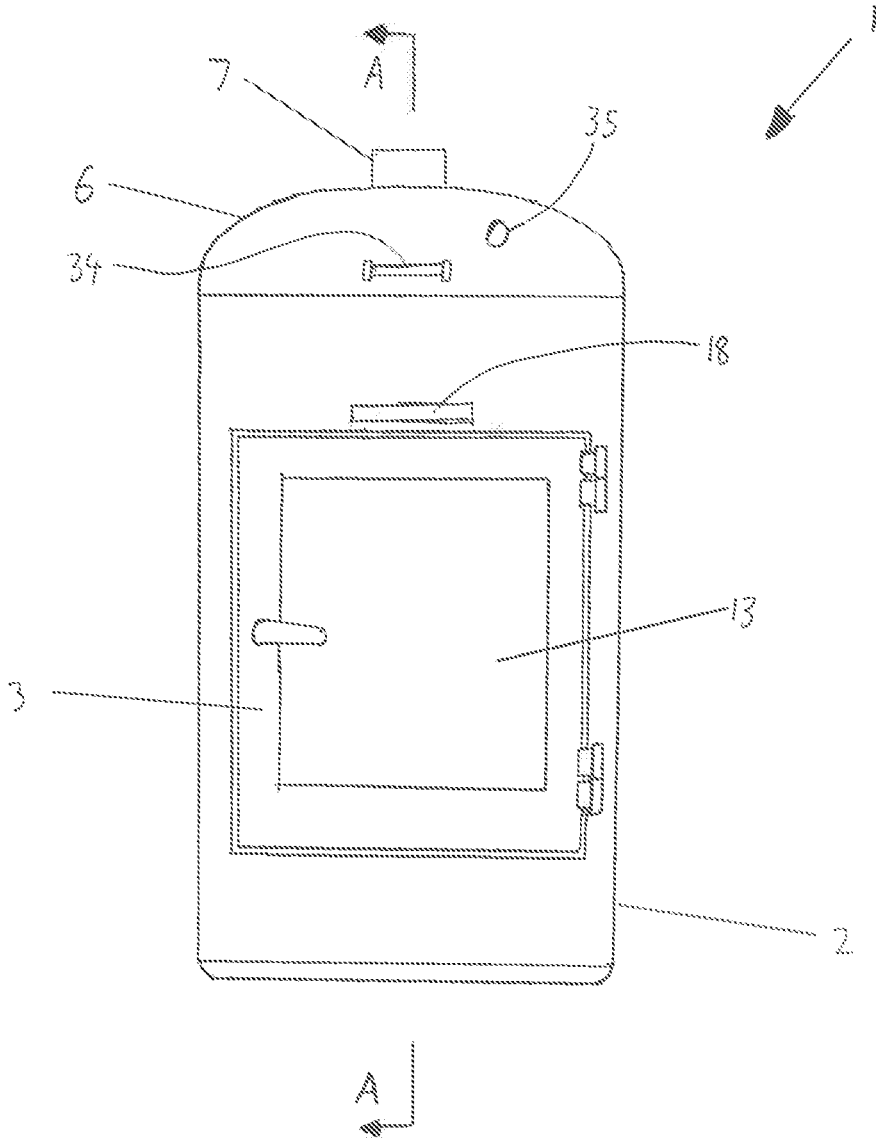
FIG. 1 is a front view of a heating appliance according to one embodiment of the invention.

Referring to FIGS. 1 to 6 of the accompanying drawings, a solid fuel heating appliance or stove 1 has a cylindrical shaped main body 2, a fire door 3, a movable baffle 4, a rotatable food holder 5, a lid 6 and a flue exhaust 7.

The cylindrically shaped main body 2 has a vertical longitudinal axis 8. The main body 2 comprises a fire-box 9 with an opening 10 at its front for placing combustible solid fuel 11, such as charcoal or logs of wood, inside a chamber 12 of the fire-box 9, and the flue exhaust 7 extends from a rear of the main body 2 above the fire-box 9. The fire door 3 is used to close the opening 10 and the fire door 3 has a glass window 13. The main body 2 has a recessed flange 14 around the opening 10 which is configured to receive the fire door 3 when the fire door 3 is closed. A seal 37 such as a rope seal, which may comprise fibre-glass, is used to seal a gap between the main body 2 and the fire door 3 when the fire door 3 is closed. The seal 37 is attached to the door 3 but it could be attached to the flange 14. The main body 2 has an air inlet, conduit or duct 15 extending from just above the opening 10 and around the back of a top portion of the flange 14 to supply air to the fire-box chamber 12. A flat member 16 including a series of slots 17 extends across the air duct 15 below an entrance 18 to the air duct 15 in the main body 2 and above the flange 14. A valve member 19 is mounted on top of the flat member 16 and the valve member 19 also includes a series of slots 20 which correspond to the series of slots 17 of the flat member 16. The valve member 19 has a handle 21 to enable the valve member 19 to be slid relative to the flat member 16 wherein the flow of air into the fire-box 9 is controlled in relation to how the valve member slots 20 are aligned with flat member slots 17. A deflector 22 is located at the exit of the air duct 15 behind the flange 14 and at the top of the opening 10. Panels, such as vermiculite insulating panels or ceramic clay panels, may be used to line the interior of at least the fire-box 9. A top of the cylindrical main body 2 has a fibrous seal 23, such as a glass-fibre seal, along its circumference.

The baffle 4 has a curved shape to conform to the cylindrical shape of the main body 2. The baffle 4 has a pair of side protrusions 24 for being received by bearings 25 extending inwardly from a main inside surface 36 of the main body 2 to enable the baffle 4 to rotate about the bearings 25. Each baffle bearing 25 includes a U-shaped recess 26 for receiving the corresponding baffle side protrusion 24 so that the baffle 4 can be simply lifted up to become disengaged from the bearings 25.

The food holder 5 has a cylindrical shape and has a circular plate 27 comprising a grill 28 for receiving food. A side wall 29 extends downwards from the circumference of the plate 27 and the side wall 29 has a pair of protrusions 30 for being received by bearings 31 extending inwardly from the main inside surface 36 of the main body 2, the bearings 31 being located just beneath the top of the main body 2. The food holder protrusions 30 enable the food holder 5 to rotate about the bearings 31. Each food holder bearing 31 includes a U-shaped recess 32 for receiving the corresponding food holder protrusion 30 so that the food holder 5 can be simply lifted out of the main body 2.

The lid 6 is dome shaped and is insulated. The lid 6 is on top of the main body 2 and is connected to the rear of the main body 2 by a hinged connection 33. The lid 6 has a handle 34 at its front so that the lid 6 can be lifted open. When the lid 6 is closed it forms a seal with the fibrous seal 23 on the top of the main body 2, covering the food holder 5. The lid 6 includes a thermometer 35, such as a dial thermometer, so that the temperature inside the lid 6 can be read. Alternatively, the thermometer may be fitted in a top or upper portion of the fire-box.

When the heating appliance 1 is to be used as an outdoor cooker, the baffle 12 is placed in the position shown in dotted lines in FIG. 4 (a "second position" to be described later). Combustible fuel 11, such as charcoal, is placed on the base of the fire-box chamber 12 and lit. The baffle 4 is then placed in a first position shown in solid line in FIG. 4 in a front part of the fire-box 9 wherein a front of a top portion of the baffle 4 rests against the back of the air duct 15. The fire door 3 is closed and the baffle 4 is disposed behind the closed fire door 3. Food is placed on the grill 28 and the lid 6 is placed over the food holder 5. A rim of the lid 6 engages the glass-fibre seal 23 on top of the main body 2 to form a seal with the main body 2. A flow of air is supplied to the fire-box chamber 12 via the air duct 15 to enable the combustible fuel 11 to burn or combust. Air from the air duct 15 is directed by the deflector 22 so that it drops down behind the fire door 3 to prevent soot/tar and smoke stains from building up on the inside of the glass window 13. The air enters a combustion zone just above the fire of the burning fuel 11 from below the baffle 4 and products of combustion pass through the flue exhaust 7. The food on the grill 28 is consequently cooked directly by heat radiating from the fuel 11 beneath being combusted and is smoked. Food may be cooked at a temperature in the range of 100° C. to 285° C. The baffle 4 in the first position provides a shield to heat radiating from the combusting fuel 11. The thermometer 35 can be checked to see the temperature of where the food is being cooked and the position of the valve member 19 can be adjusted if need be to control the supply of air into the chamber 12 and hence control the cooking.

Figure 2:
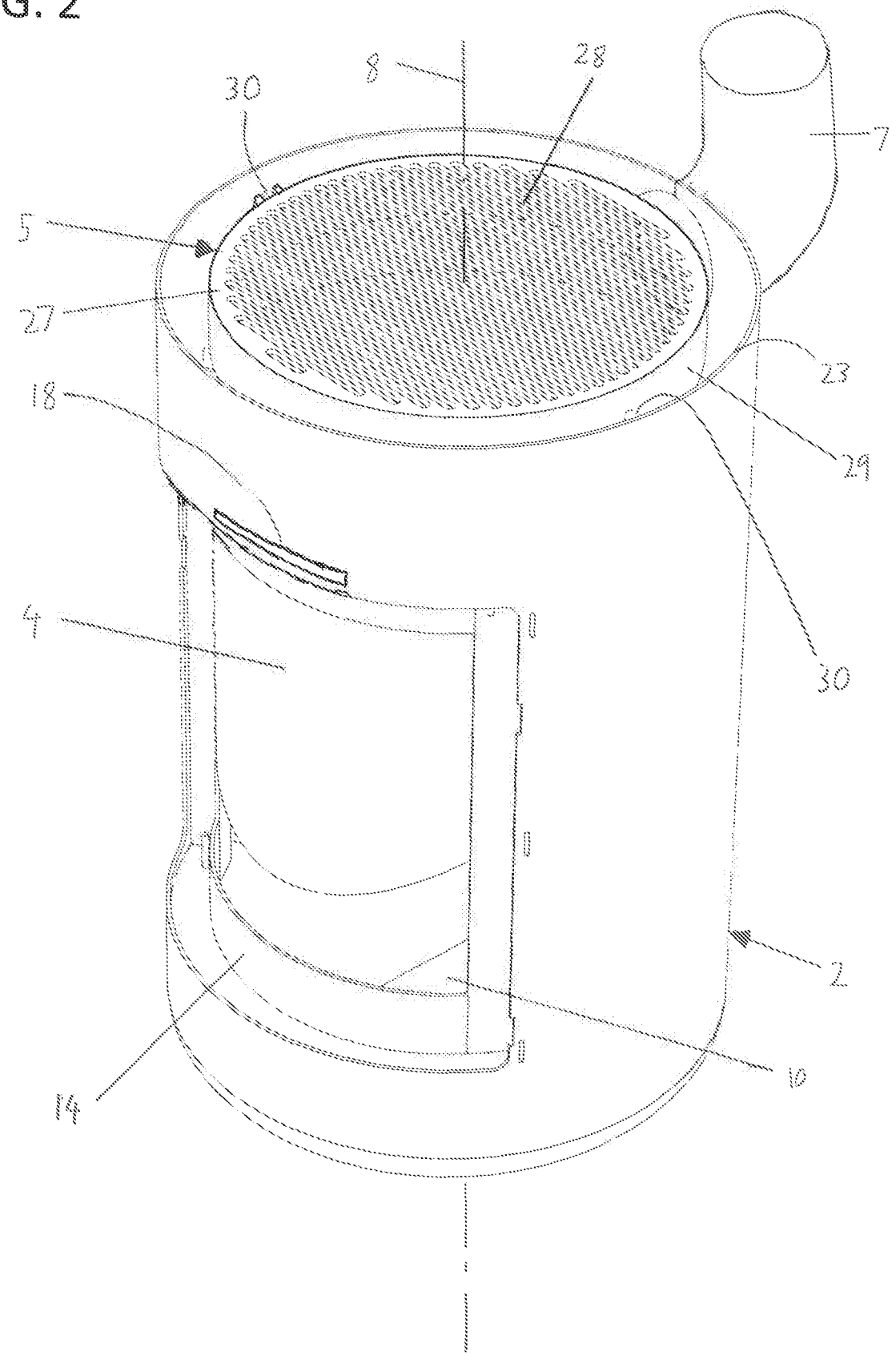
FIG. 2 is a perspective view of the heating appliance with a lid and a fire door of the heating appliance omitted.
Figure 3:
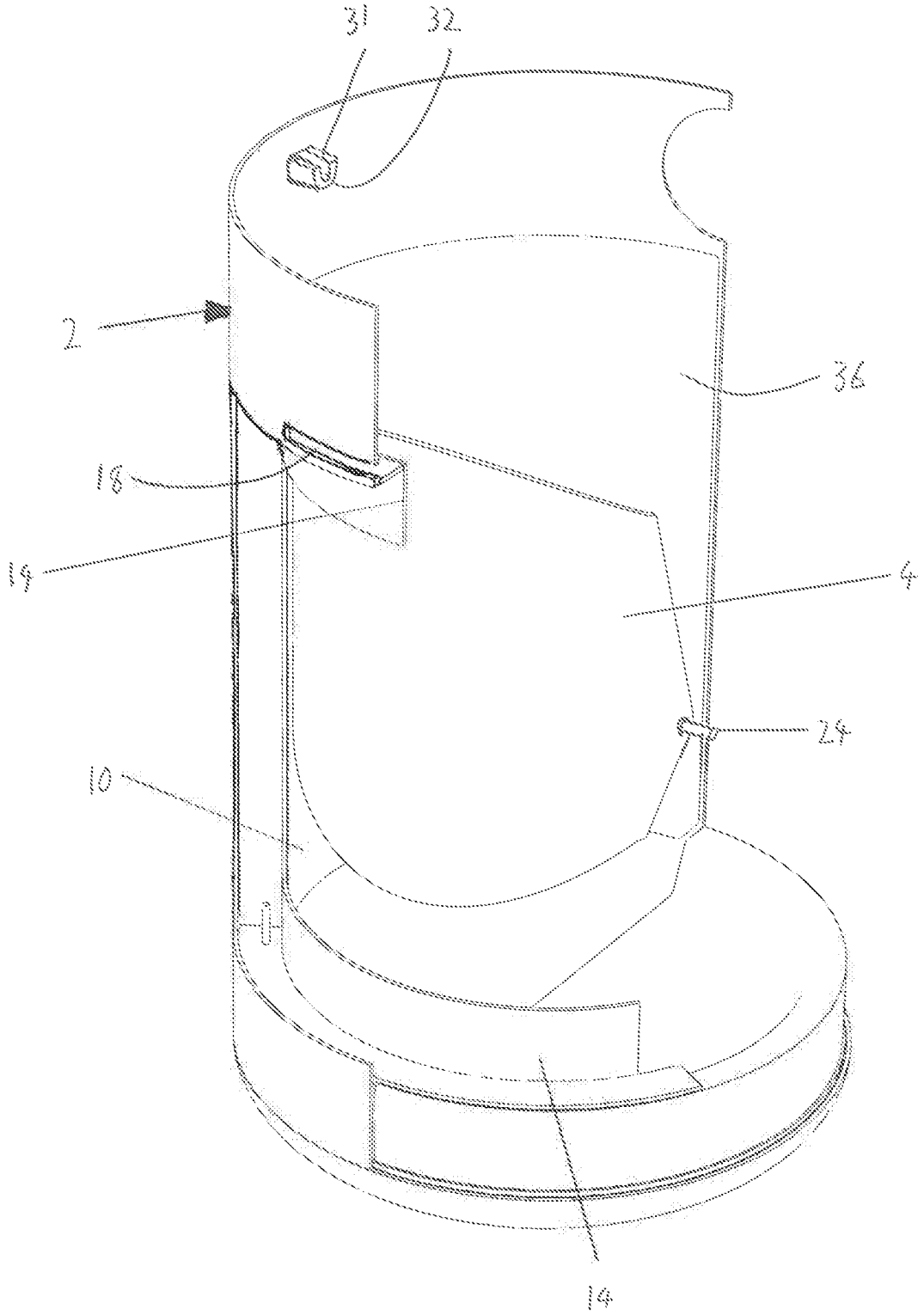
FIG. 3 is an isometric sectional view taken along lines A-A of FIG. 1 with the lid, fire door, a food holder and part of an air duct of the heating appliance omitted and showing a baffle of the heating appliance in a first position.
Figure 4:
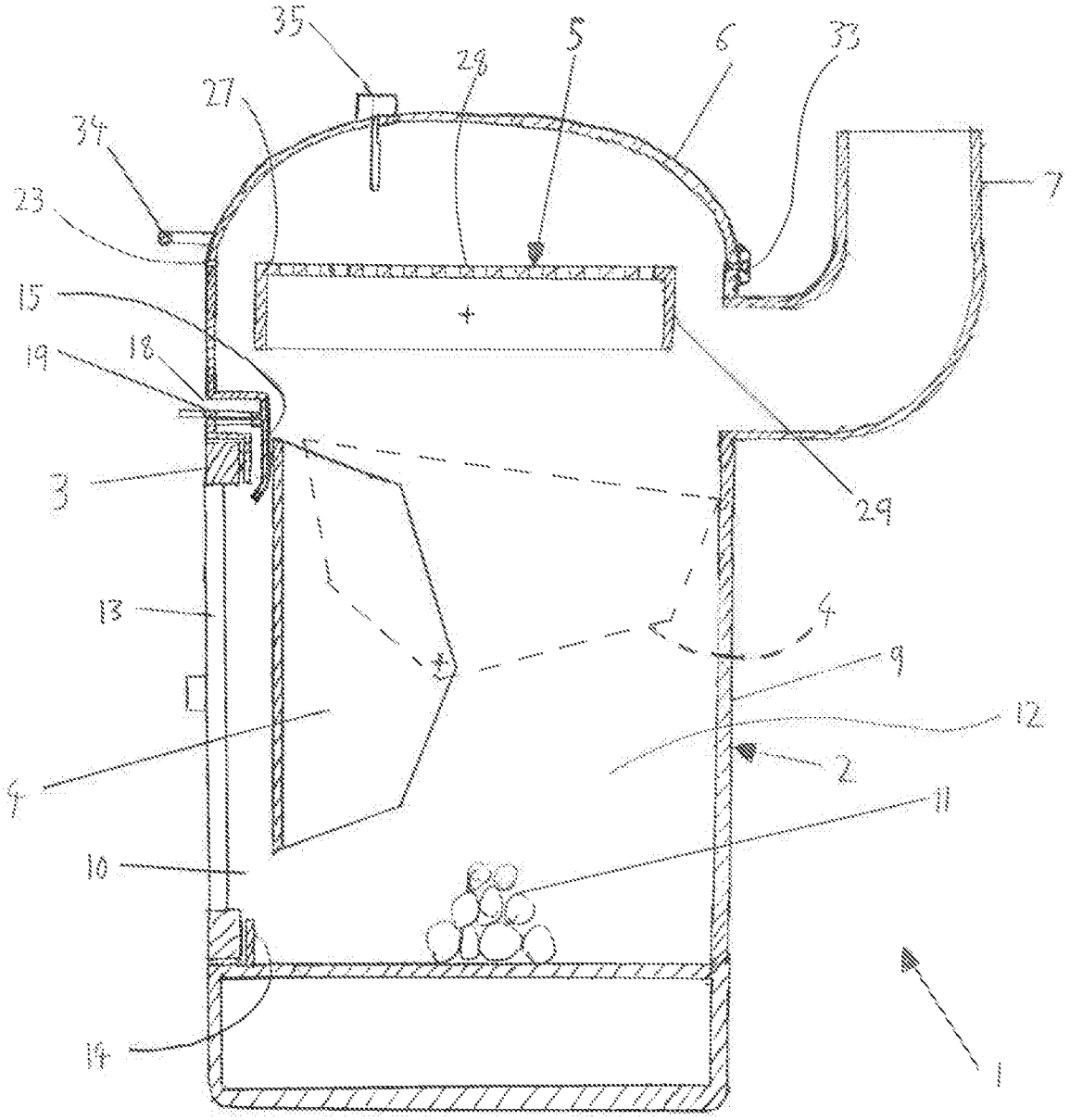
FIG. 4 is sectional view taken along lines A-A of FIG. 1 including the lid, fire door and food holder.
Figure 5:
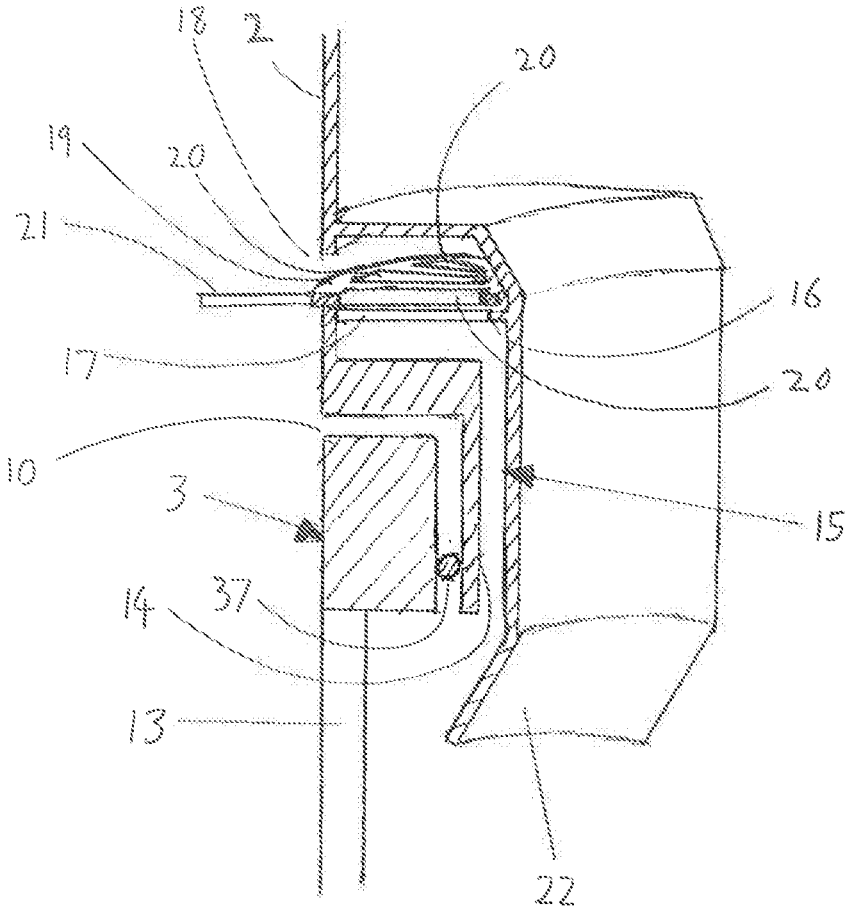
FIG. 5 is a detail of an air duct shown in FIG. 4.
Figure 6:
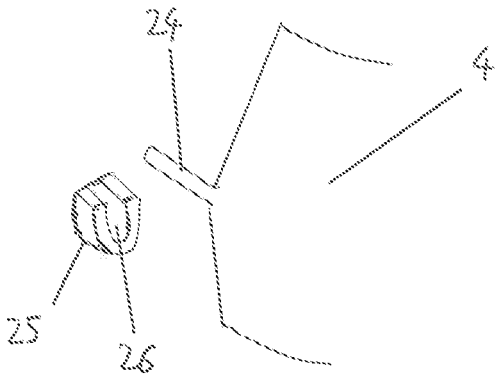
FIG. 6 is a detail of a portion of the baffle and a bearing.
Figure 7:
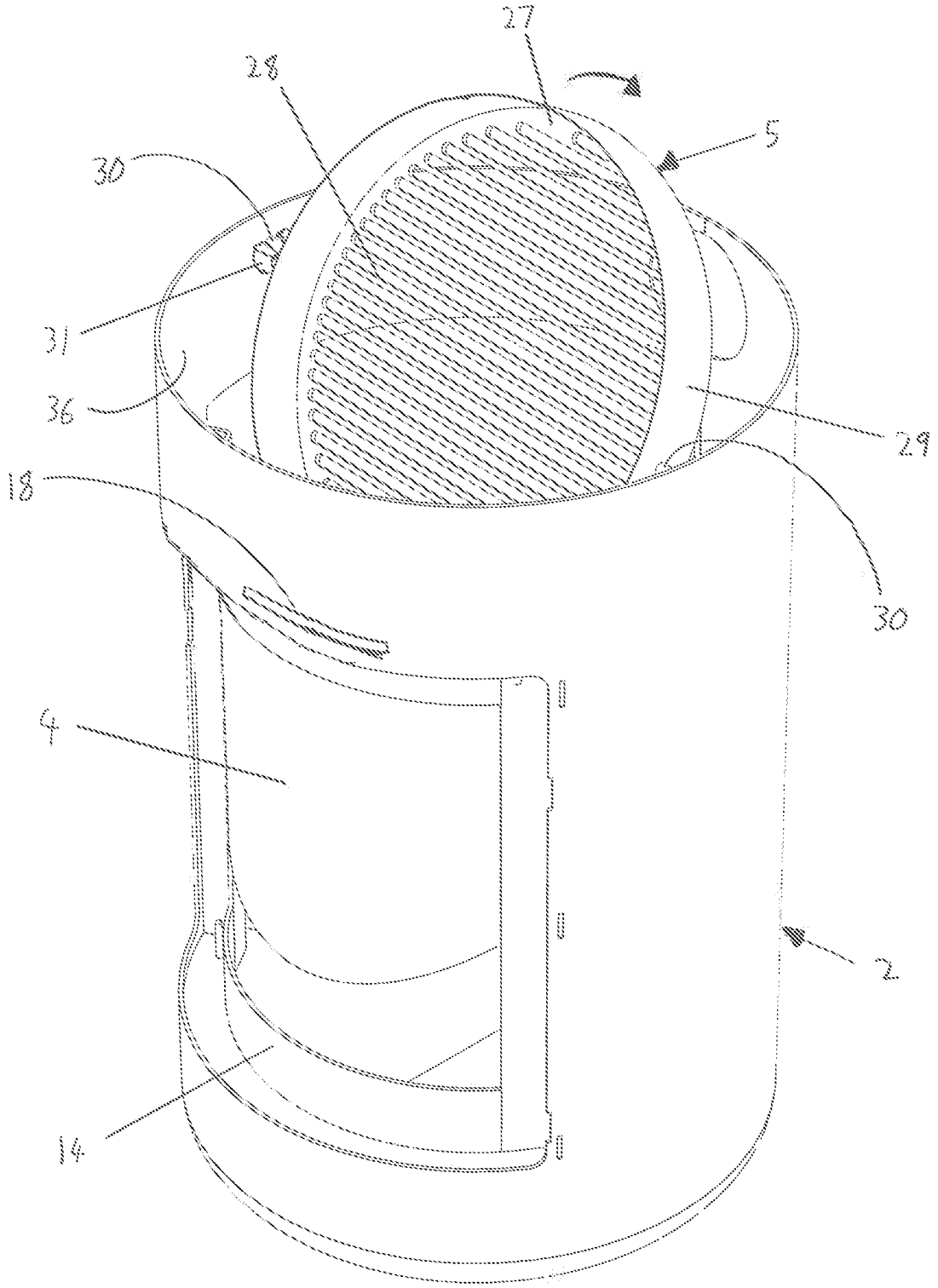
FIG. 7 is a perspective view of the heating appliance similar to FIG. 2 with the food holder in process of being rotated towards a second position, and a flue exhaust of the heating appliance omitted.
Figure 8:
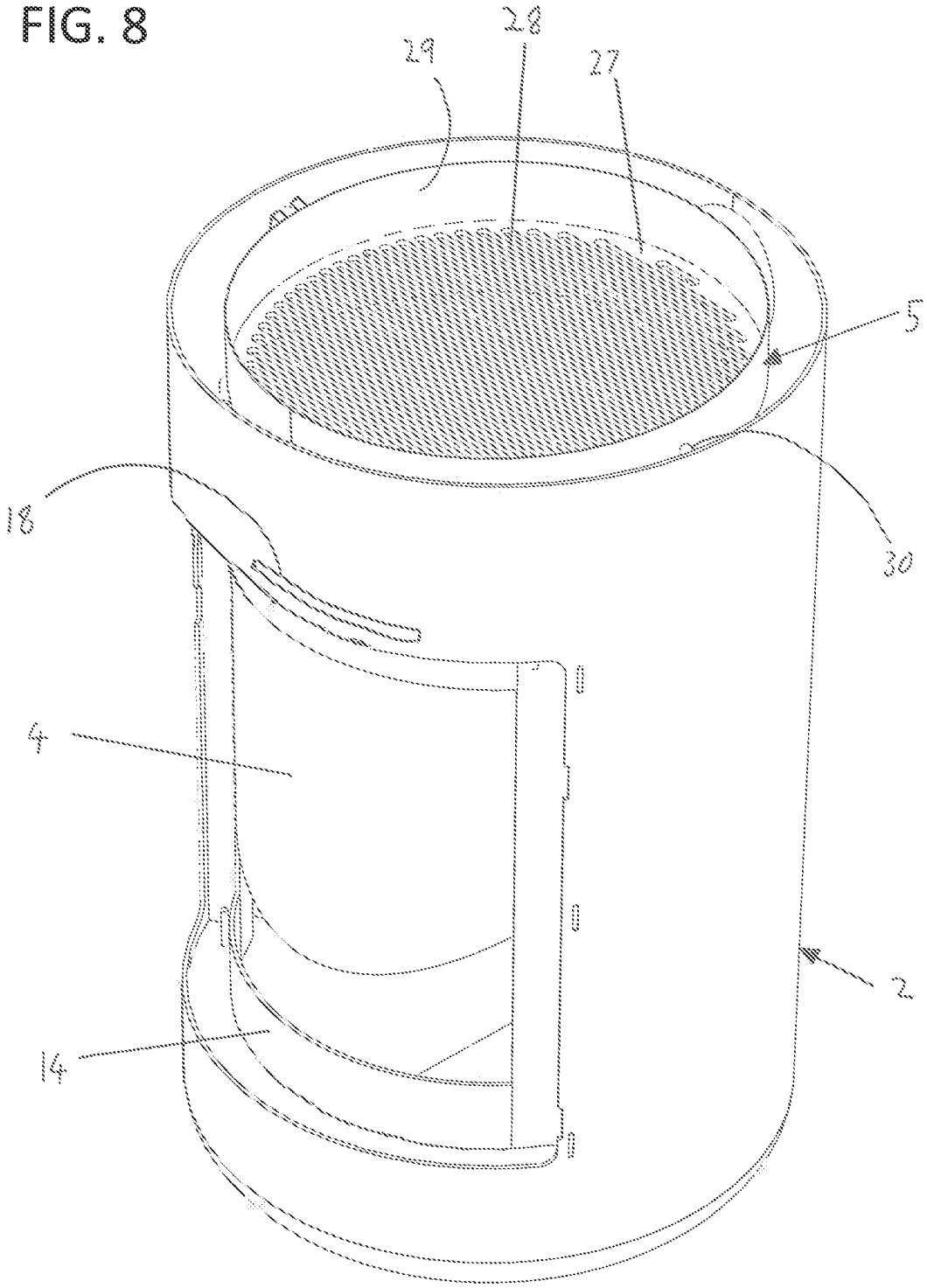
FIG. 8 is a perspective view of the heating appliance similar to FIG. 7 with the food holder in the second position.

In FIGS. 2 and 4, the food holder 5 is positioned so that the circular plate 27 is flush with the top of the main body 2 of the heating appliance 1. If a large portion of food is to be cooked then the food holder 5 is rotated through 180° (see FIG. 7) so that the circular plate 27 is below the top of the main body 2 (see FIG. 8) providing a greater depth for receiving the food.

Figure 9:
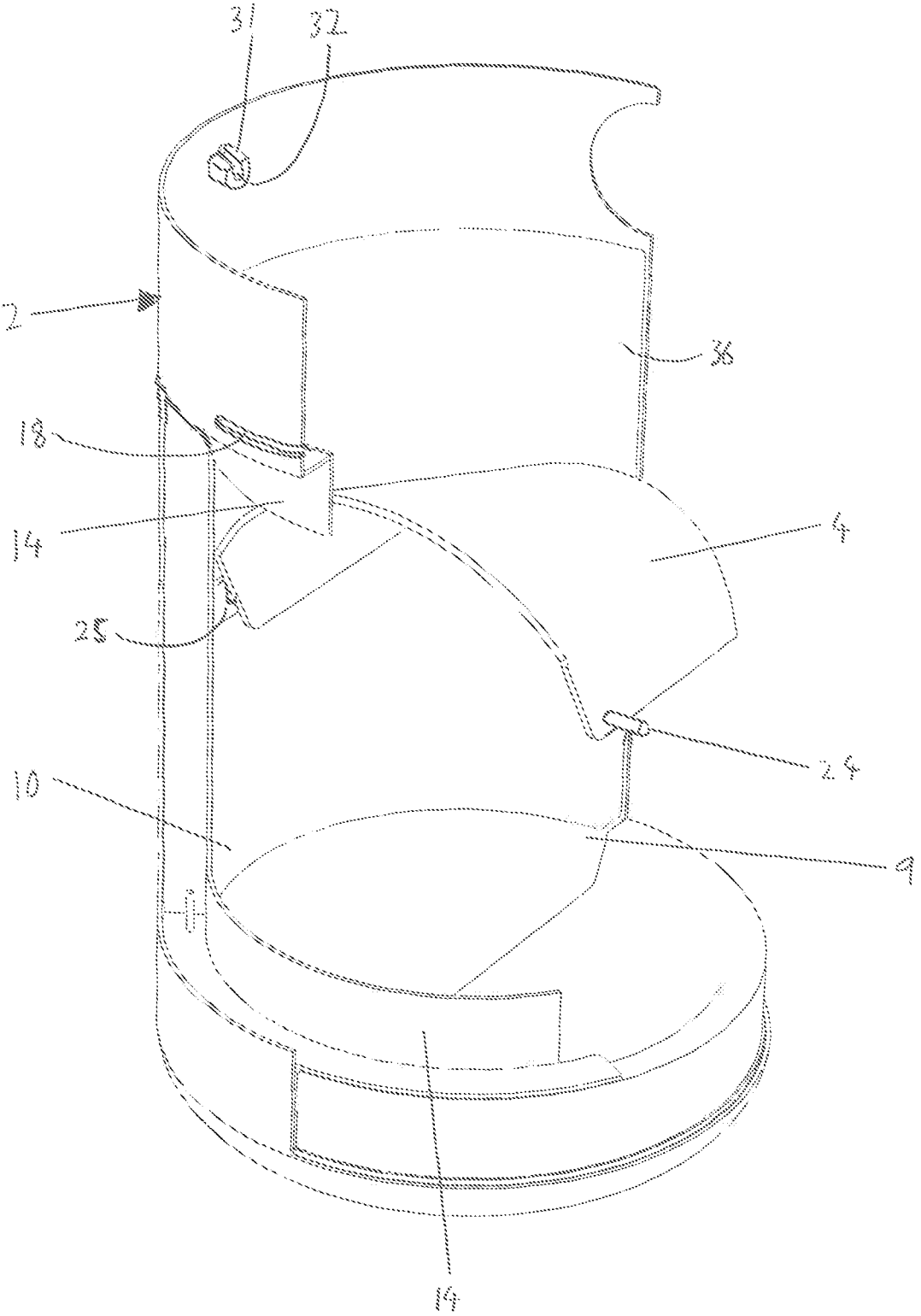
FIG. 9 is an isometric sectional view similar to FIG. 3 and showing the baffle in a second position.

Referring to FIGS. 4 and 9, when the heating appliance 1 is to be used as an outdoor heater, the lid 6 is kept closed to prevent heat escaping from the top of the heating appliance 1 and to enable heat output to be controlled. The baffle 4 is rotated to the second position (shown in dotted lines in FIG. 4) wherein the baffle 4 is in a top part of the fire-box 9 and below the food holder 5 and the flue exhaust 7. The fire door 3 is opened to provide space for the baffle 4 to rotate. The baffle 4 is tilted slightly rearward to the horizontal and a rear of the baffle 4 rests against a rear of the fire-box chamber 12. The baffle 4 may be made of steel and may be weighted so as to be easily rotated between the first position and the second position. Combustible fuel 11, such as wood, is placed on the base of the fire-box chamber 12 and lit. Heat from the burning fuel 11 is directed by the baffle 4 through the window 13 of the door 3 to warm the area in front of the heating appliance 1. Flames from the combusting fuel are deflected by the baffle 4 towards the front of the fire-box 9 to engage and mix with air from the air duct 15 wherein the air in the air duct 15 is heated by heat radiating from the combusting fuel 11. This preheated air from the air duct 15 is drawn to the flames igniting volatiles and unburnt carbons emitting from the combusting fuel causing secondary combustion. This may take place at temperatures in the range of 600° C. to 700° C. Air from the air duct 15 is directed by the deflector 22 so that it drops down behind the fire door 3 to prevent soot/tar and smoke stains from building up on the inside of the glass window 13.

Products of combustion have a tortuous route to the flue exhaust 7 as they have to pass in front of a gap between the baffle 4 and the air duct 15, and to each side of the baffle 4. Alternatively, the baffle 4 may be simply removed from the fire-box 9 when the heating appliance 1 is to be used as an outdoor heater.

An extension piece (not shown) may be attached to the end of the flue exhaust 7 to raise its height.

In a modification, the air inlet or duct is located in a top portion of the fire door of the heating appliance instead of above the opening. The heating appliance may also include a second air inlet or duct below the fire door. In another modification, the flue exhaust may be in the lid.

Figure 10:
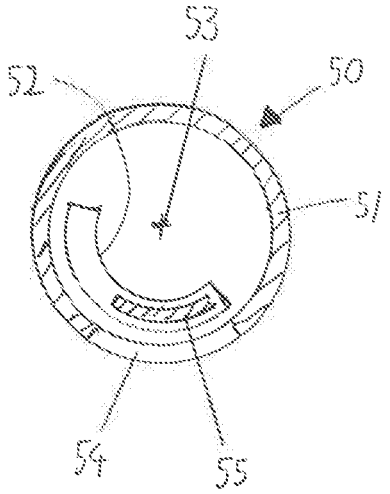
FIG. 10 is a sectional view from above of a modified heating appliance showing the baffle in a first position.
Figure 11:
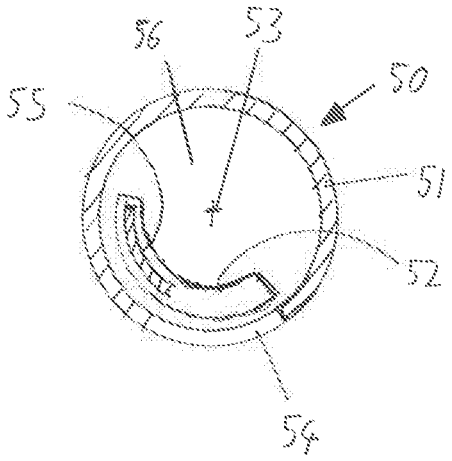
FIG. 11 is a sectional view similar to FIG. 10 and showing the baffle in a second position.

FIGS. 10 and 11 both illustrate a section through a modified heating appliance 50. A base of an inside of a fire-box 51 has a track 52 curved relative to a longitudinal axis 53 of the heating appliance 50. The track 52 runs behind a fire-box opening 54 and to one side of the opening 54. A baffle 55 comprising a curved plate is configured to be slid along the curved track 52 about the longitudinal axis 53 between a first positon and a second position. When the baffle 55 is in the first position the baffle 55 provides a shield to heat radiating from fuel combusting in the fire-box 51 and when the baffle 55 is in the second position the baffle 55 is to one side of the opening 54 enabling access to a chamber 56 of the fire-box 51.

Figure 12:
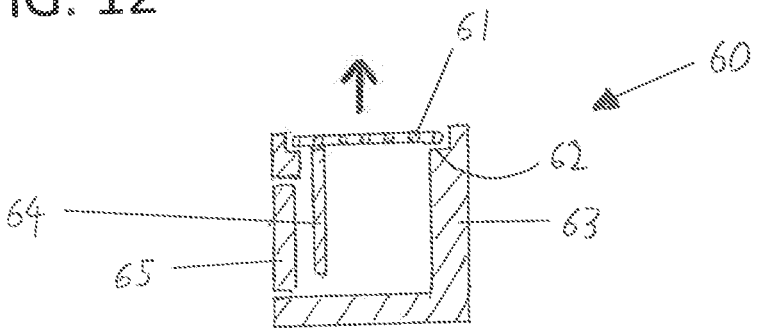
FIG. 12 is a side sectional view of part of another modified heating appliance.

In another modification illustrated in FIG. 12, a grill 61 is supported by an annular recess 62 in a top of a main body 63 of a heating appliance 60. The grill 61 has a baffle 64 attached to it that extends downward behind a closed fire door 65. When the heating appliance 60 is to be used as an outdoor heater the grill 61 with the attached baffle 64 is simply lifted out of the main body 63.

Figure 13:
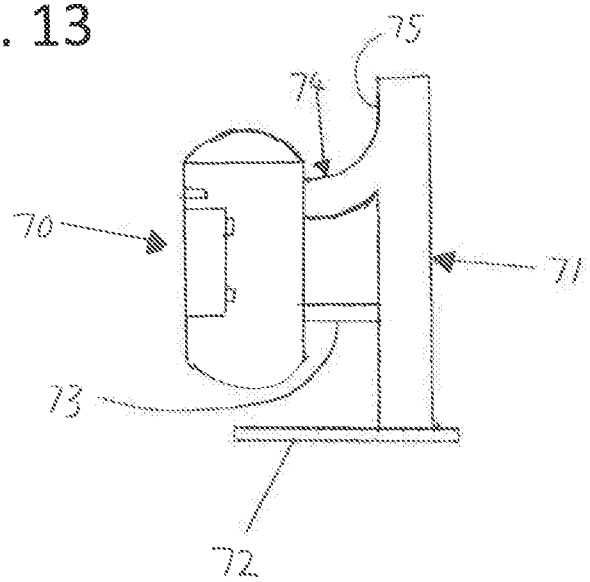
FIG. 13 is a side elevational view of another modified heating appliance.

In another modification illustrated in FIG. 13, a heating appliance 70 is supported by a cylindrical column 71 extending from a stand 72. A lower part of a rear of the heating appliance 70 is attached by a bracket 73 to the cylindrical column 71 and an upper part of the rear of the heating appliance 70 is attached to the cylindrical column 71 by a flue exhaust 74 of the heating appliance 70 wherein a distal upright portion 75 of the flue exhaust 74 forms an upper part of the cylindrical column 71.

Whilst particular embodiments have been described, it will be understood that various modifications may be made without departing from the scope of the claimed invention. The main body of the heating appliance may have a cuboid shape or any other suitable shape. The baffle may have any suitable shape and may comprise a substantially rectangular plate.

The heating appliance may include a grate at the base of the fire-box and an ashpan beneath.

The invention claimed is:

1. A heating appliance comprising a main body having a fire-box with an opening at its front for placing therein associated combustible fuel with which said heating appliance is used, a fire door for closing said opening, and a baffle which is movable between a first position and a second position, wherein said fire door has a window, and when said baffle rests in said first position, the baffle is disposed in a front part of said fire-box and is in an upright position, and the baffle is behind said fire door so as to form a shield for said fire door from heat generated by the associated combustible fuel in use, and when said baffle rests in said second position, the baffle is disposed at an upper part of said fire-box and forms a shield for a top of said fire-box from the heat generated by combustible fuel in use beneath, and at least some heat generated by the associated combustible fuel in use is directed by said baffle through said window.

2. The heating appliance as claimed in claim 1, including a food holding part above said fire-box, in which heat generated by the associated combustible fuel in use cooks food with which said heating appliance is used which is placed in or on said food holding part.

3. The heating appliance as claimed in claim 2, wherein said food holding part comprises a food receiving member.

4. The heating appliance as claimed in claim 3, wherein said food holding part is rotatably connected to said main body and is rotatable between first and second food holding part positions, wherein when said food holding part is in said first food holding part position said food receiving member is higher above said fire-box than when said food holding part is in said second food holding part position.

5. The heating appliance as claimed in claim 4, wherein when said food holding part is in said first food holding part position said food receiving member is substantially at a top of said main body.

6. The heating appliance as claimed in claim 1, wherein said main body is substantially cylindrical in shape and has a substantially vertical longitudinal axis.

7. The heating appliance as claimed in claim 1, wherein said baffle is removable from said heating appliance.

8. The heating appliance as claimed in claim 1, including at least one air inlet for supplying air to an inside of said fire-box for combusting the associated combustible fuel.

9. The heating appliance as claimed in claim 8, wherein said at least one air inlet is located above said fire door.

10. The heating appliance as claimed in claim 8, wherein said at least one air inlet is located in a top portion of said fire door.

11. The heating appliance as claimed in claim 1, including a lid to form a seal with said main body.

12. The heating appliance as claimed in claim 2, including a lid to form a seal with said main body, and wherein said lid is configured to cover said food holding part.

* * * * *